US006658869B1

(12) United States Patent
Thornbrough

(10) Patent No.: US 6,658,869 B1
(45) Date of Patent: Dec. 9, 2003

(54) MICROCONTROLLER ICE MAKER

(76) Inventor: Kenneth L. Thornbrough, Rte. 1, Box 107, Mountain View, OK (US) 73062

( * ) Notice: Subject to any disclaimer, the term of this patent is extended or adjusted under 35 U.S.C. 154(b) by 0 days.

(21) Appl. No.: 10/155,348

(22) Filed: May 24, 2002

(51) Int. Cl.[7] ..... F25C 1/00; F25C 5/08
(52) U.S. Cl. ..... 62/137; 62/351
(58) Field of Search ..... 62/137, 351, 353

(56) References Cited

U.S. PATENT DOCUMENTS

| | | | | |
|---|---|---|---|---|
| 3,362,182 A | * | 1/1968 | Walker | 62/137 |
| 3,407,619 A | * | 10/1968 | Walker | 62/137 |
| 3,514,964 A | * | 6/1970 | Dodge, III et al. | 62/137 |
| 3,828,568 A | * | 8/1974 | Frazier | 62/186 |
| 3,850,008 A | * | 11/1974 | Frazier | 62/353 |
| 4,062,201 A | * | 12/1977 | Schumacher et al. | 62/353 |
| 4,233,819 A | | 11/1980 | Stottmann | |
| 4,429,550 A | * | 2/1984 | Latter | 62/353 |
| 4,833,894 A | | 5/1989 | Chestnut | |
| 5,160,094 A | | 11/1992 | Willis | |
| 5,329,786 A | | 7/1994 | Willis | |

* cited by examiner

*Primary Examiner*—William E. Tapolcai
(74) *Attorney, Agent, or Firm*—Randal D. Homburg

(57) ABSTRACT

The invention is an ice maker fitted within the freezer compartment of a refrigerator attached to an existing water and electrical source, the ice maker controlled by a microcontroller. A metal ice tray with partially deformed cups in line on a common base are filled with water and which freezes to form ice cubes, the cups having a rod with small fingers to elevate the frozen ice from the cups. When the ice is ready for ejection, the microcontroller senses by a thermal sensor the programmed temperature causing the ejection sequence to commence, rotating the ice tray as the ice tray is heated to release the ice cubes from the tray, at which time the rods forcibly eject the ice cubes into a storage bin. An upright bail is then lowered into the ice bin to detect the level of ice, signaling the microcontroller to continue or discontinue ice production. The ice tray is returned to an upright position and the cycle is repeated if the ice bin has not reached its programmed capacity, as indicated by the bail upon the return of the bail to an upright position.

3 Claims, 10 Drawing Sheets

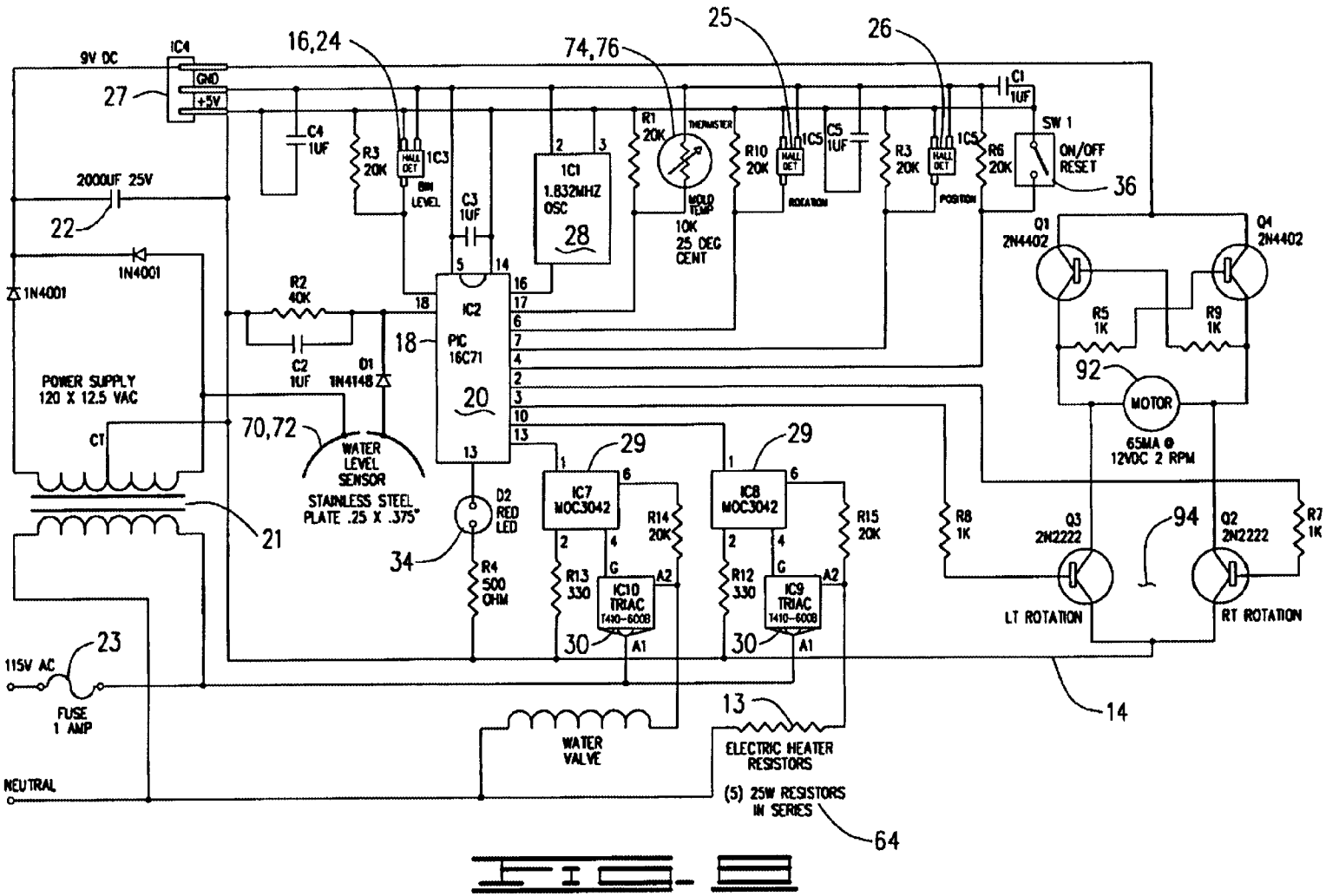
Q4 2N4402
Q1 2N4402
R9 1K
R5 1K
MOTOR
65MA @ 12VDC 2 RPM
92
94
R7 1K
R8 1K
Q2 2N2222
Q3 2N2222
RT ROTATION
LT ROTATION
14
SW 1
ON/OFF RESET
36
C1 1UF
R6 20K
C2
HALL DET
POSITION
26
R3 20K
C5 1UF
C5
ROTATION
25
R10 20K
THERMISTER
MOD TEMP 10K 25 DEG CENT
74,76
R1 20K
IC1 1.832MHZ OSC
28
IC2 PIC 16C71
20
18
C3 1UF
C3
LEVEL
16,24
R3 20K
C4 1UF
D1 1N4148
R2 40K
C2 1UF
WATER LEVEL SENSOR
STAINLESS STEEL PLATE .25 X .375"
70,72
21
D2 RED LED
R4 500 OHM
34
R15 20K
IC8 MOC3042
29
IC9 TRIAC
R12 330
30
R14 20K
IC7 MOC3042
IC10 TRIAC
R13 330
WATER VALVE
ELECTRIC HEATER RESISTORS
(5) 25W RESISTORS IN SERIES
13
64
IC4
GND
+5V
27
9V DC
2000UF 25V
22
1N4001
POWER SUPPLY 120 X 12.5 VAC
CT
23
115V AC
FUSE 1 AMP
NEUTRAL IS THE EJECTOR ARM IN THE HOME POSITION ?
NO
YES
TURN OFF HEATER AND GO TO START
CHECK EJECTOR ARM POSITION
HAVE ICE CUBES RELEASED EJECTOR ARM ?
NO
YES
CHECK TIME
TIME TOO LONG?
NO
YES
TURN ON MOTOR AND TURN OFF HEATER
ROTATE FOR 8 SECONDS

MICROCONTROLLER ICE MAKER

I. BACKGROUND OF THE INVENTION

1. Field of Invention

The present invention is an improved ice maker, incorporated into the existing water supply and electrical connection within the freezer compartment of a refrigerator, the improved ice maker having a microcontroller that coordinates the making of ice in the ice maker through temperature sensors, electric heater arrays separating the frozen ice cubes from the tray of aluminum cups which form the ice cubes, the temperature sensors keying the process of heating the tray, rotating the tray, ejecting the cubes, and returning the tray to position to form new ice cubes, during which a bail arm is lowered to check the level of ice in the storage container which holds the ejected ice cubes, the bail arm sensing the amount of ice cubes in the container to determine if more ice is needed. The ice maker also has sensors to determine if a problem has occurred in the ice maker, signaling the microcontroller to cancel the ice making process and activate a warning system to alert the consumer that the ice maker is experiencing a problem which needs to be remedied and the ice maker in need of being reset to resume function.

2. Description of Prior Art

The following United States patents were discovered and are disclosed within this application for utility patent. All relate to ice makers, but none of them utilize the microcontroller which controls the actions and operation of the devices.

U.S. Pat. Nos. 5,329,786 and 5,160,094 to Willis disclose ice makers which involves an ice tray having a heater element to partially thaw the ice from the ice maker after which ejector blades force the ice from the tray into an ice bin. This device includes a thermostat which controls the start process of the ice ejection, which comprises the electrical circuit constituting several switches, a motor and a thermostat. This device senses water in the ice tray, commences an ejection process where the ice tray remains stationary and the blades rotate in a circular pattern, with some heat applied to the ice tray to promote removal of the ice from the tray, and a bale arm rotates up and down in a cycle to indicate whether to continue ice production or not, with a sensor to stop the ice making process when the bale arm gets stuck in the ice. The bale arm is generally down when at rest.

An ice maker with a heater to assist in dislodging ice from the trays is also disclosed in U.S. Pat. No. 4,833,894 to Chesnut, having a fuse in the heating element to prevent overheating of the ice. In U.S. Pat. No. 4,233,819 to Stottmann, an ice maker is disclosed having a rotating ice tray with concave cups on opposing sides of a rotating axis filled with cryogenic liquified gas to freeze ice in the tray and release the ice when inverted as new water is added to the tray on the opposite side of the axis, this cycle repeating perpetually, with the cryogenic liquid gas cooling the empty tray by fluid gravity.

None of these or any other patent searched discloses an ice maker with the microcontroller controlled circuitry of the present invention, nor does it employ a combination of ice tray rotation with retractable ejector arms, a heating device attaching to the tray, water level sensors, thermal sensors and a bale arm which is in the upright position, traveling downward to check the level of the ice in the storage bin, returning to an upright position when inactive, nor do the previous inventions have any reset means to indicate a variety of system failures derived from circuit feedback causing the ice maker to halt further ice production until the problem is remedied.

II. SUMMARY OF THE INVENTION

The primary objective of the invention is to provide an ice maker controlled by a programmed microcontroller to expedite the efficient production of ice, the microcontroller coordinating the filling of ice to the tray, the determination of when the ice is frozen, the mechanical ejection process including the rotation of the ice tray while heating the ice tray, the spring-loaded ejection process, the return of the ice tray to level, the movement of the bale arm to determine a variable amount of ice in the ice bin under the ice maker, and the continued cycle of the above ice making process, with a system signal return indicating the working order of the system to continue the ice making cycle.

A secondary objective of the invention is to have the bale arm positioned up and out of the way at rest to prevent damage to the bale arm during removal of the ice storage bin.

A third objective of the invention is to provide the ice maker with a constant safety status monitor to deactivated the system when a system problem of failure is noted in the programming due to a component malfunction of cessation of programmed operation until the problem is remedied. A fourth objective of the invention is to reduce the number of moving components in the ice maker fro prior art ice makers to reduce the number of moving component failures, as well as general failure of moving components due to movement and friction associated with normal operation over time.

III. DESCRIPTION OF THE DRAWINGS

The following drawings are submitted with this utility patent application.

FIG. 6 is a front view of the PC board with the attached electrical components.

FIG. 8 is a circuit diagram of the ice maker.

Figure 1:
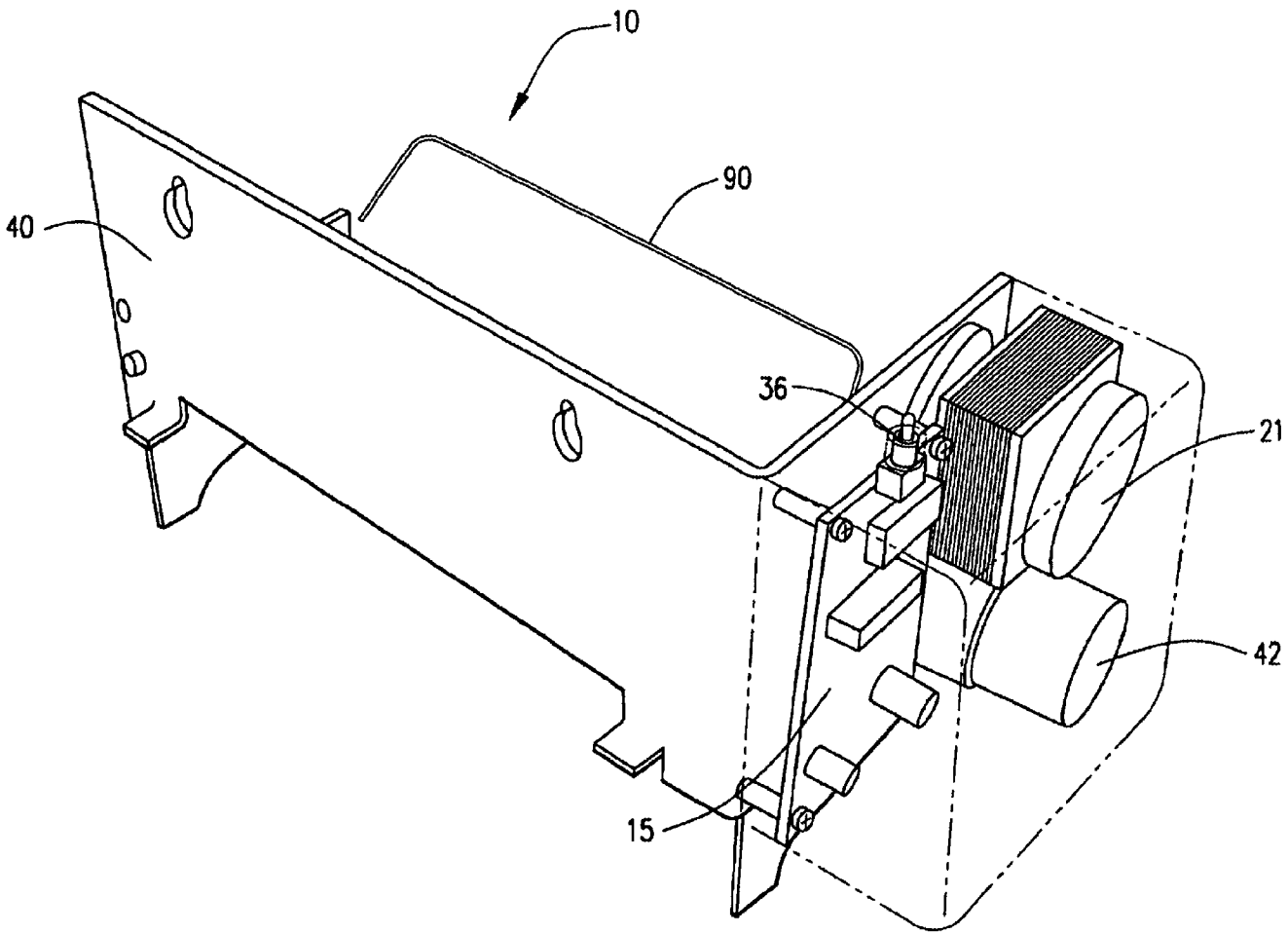
FIG. 1 is a perspective view of the invention.

FIGS. 9*a*–9*d* are a representative flow chart of the operation of the ice maker.

IV. DESCRIPTION OF THE PREFERRED EMBODIMENT

The invention, as shown in FIGS. 1–8 of the drawings, is a microcontroller operated ice maker 10 attaching to a wall of a freezer compartment of a refrigerator, utilizing an existing water line and an electrical supply within the freezer compartment, the ice maker 10 essentially comprising a grounded combination heat sink support bracket 40, a low voltage electrical motor 42, a metal ice tray 50 having a plurality of cylindrical cups 54, a means 12 of ejecting ice cubes from the metal ice tray 50 during rotation of the metal ice tray 50, a means 13 of heating the metal ice tray 50 to aid in the removal of the ice cubes from the metal ice tray, a multiplicity of electrical components 14, including a programmable microcontroller 20, attaching to a PC board 15 to compel the operation of the ice maker 10, a water level indicator 70, a water temperature indicator 74, a means 16 of sensing the level of ice in an ice cube bin 100 to determine whether to continue the production of ice cubes by the ice maker 10, and a means 18 of monitoring the ice maker 50 to deactivate the ice maker 50 in the event of a failure within the ice maker 50.

Figure 7:
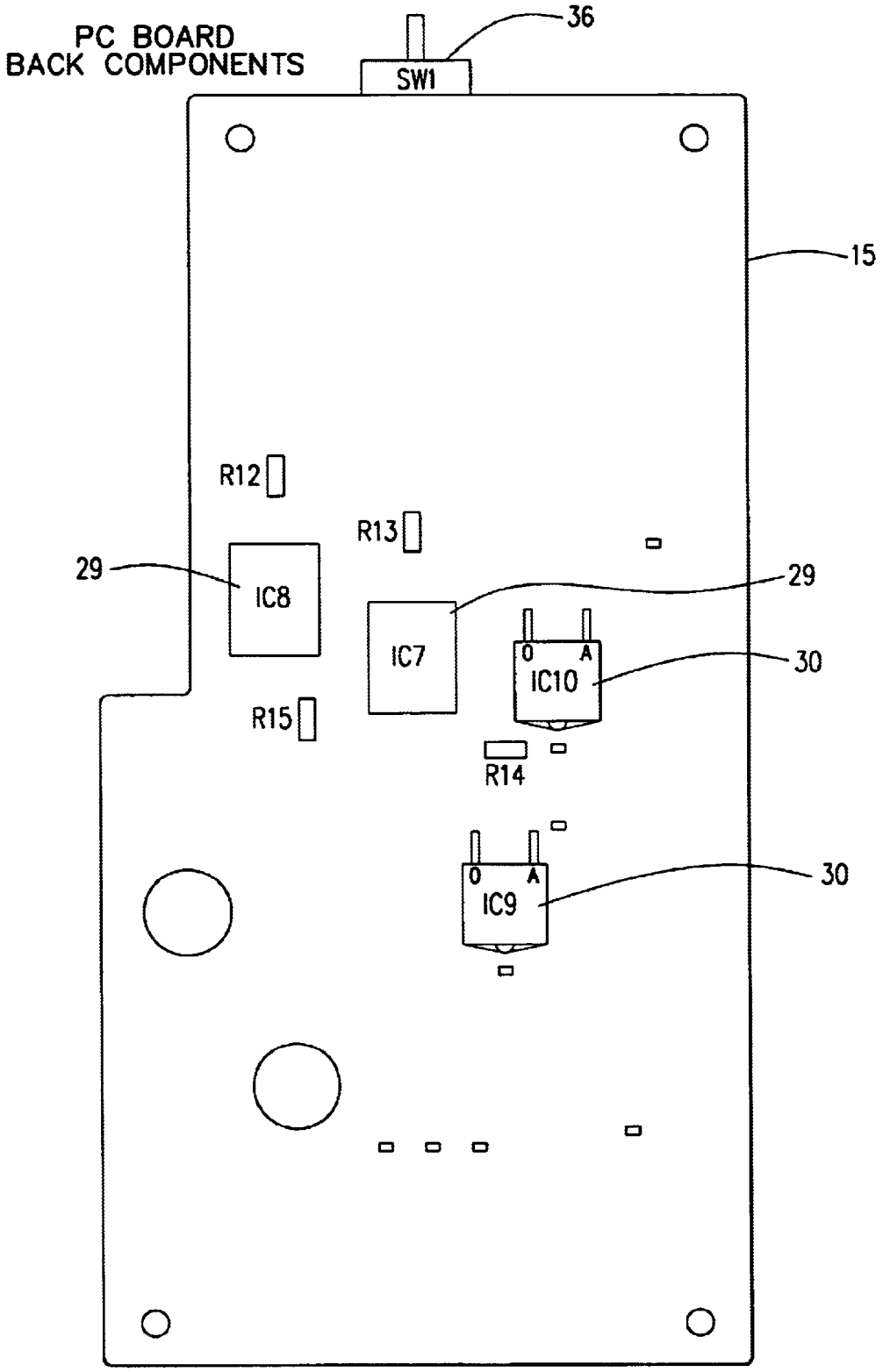
FIG. 7 is a rear view of the PC Board with the attached electrical components.
Figure 9B:
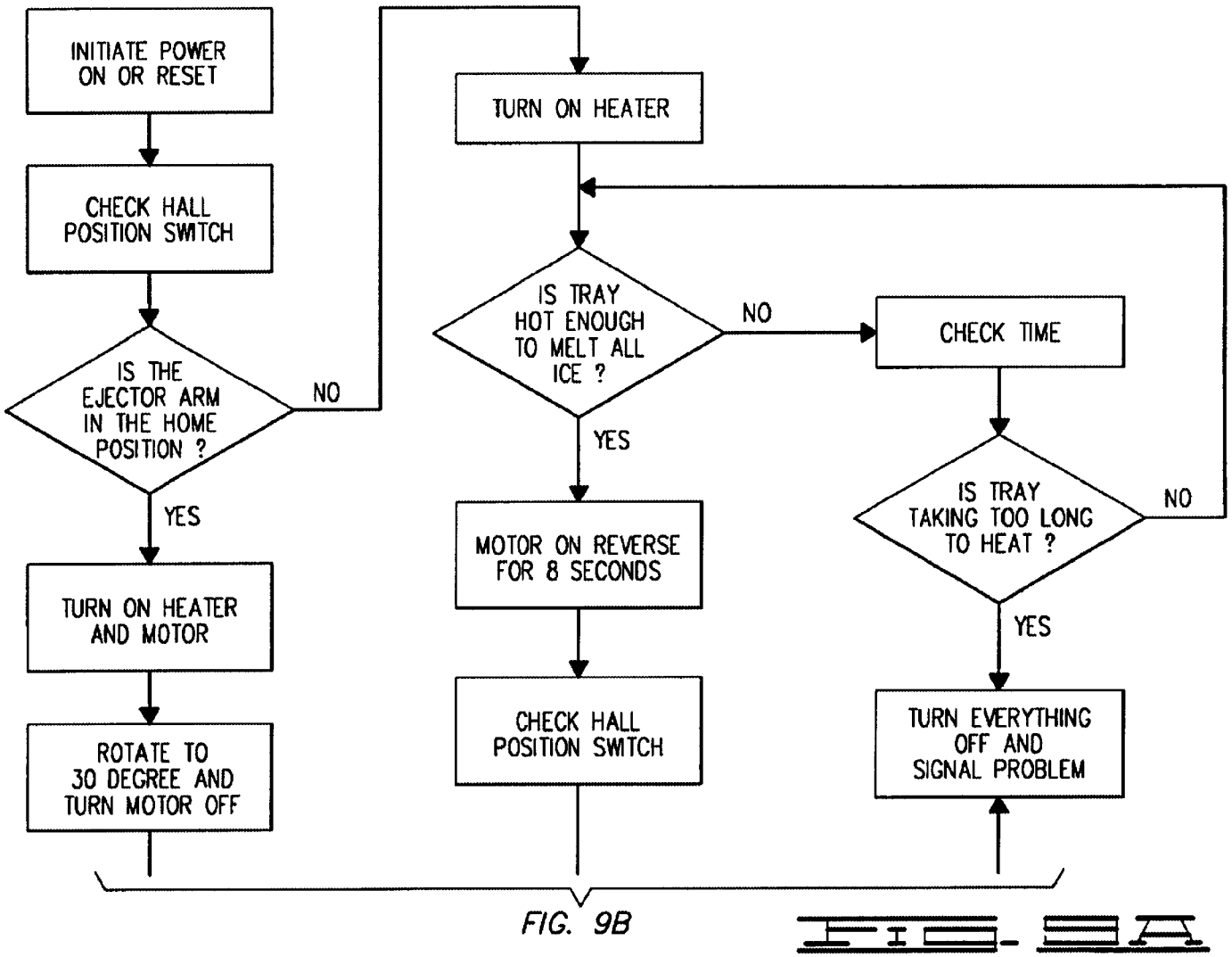
Figures 9A, 9C:
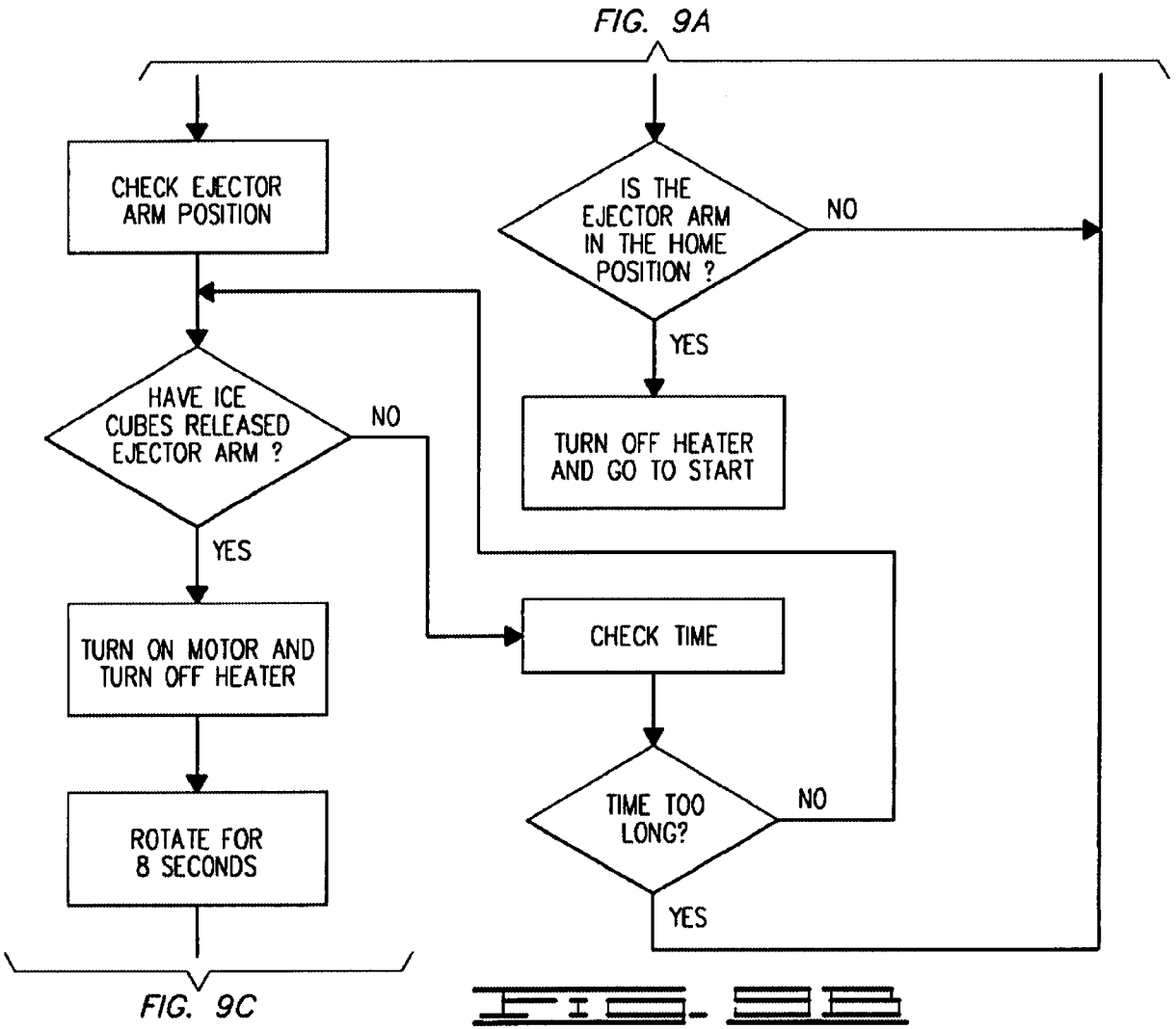
Figure 9C:
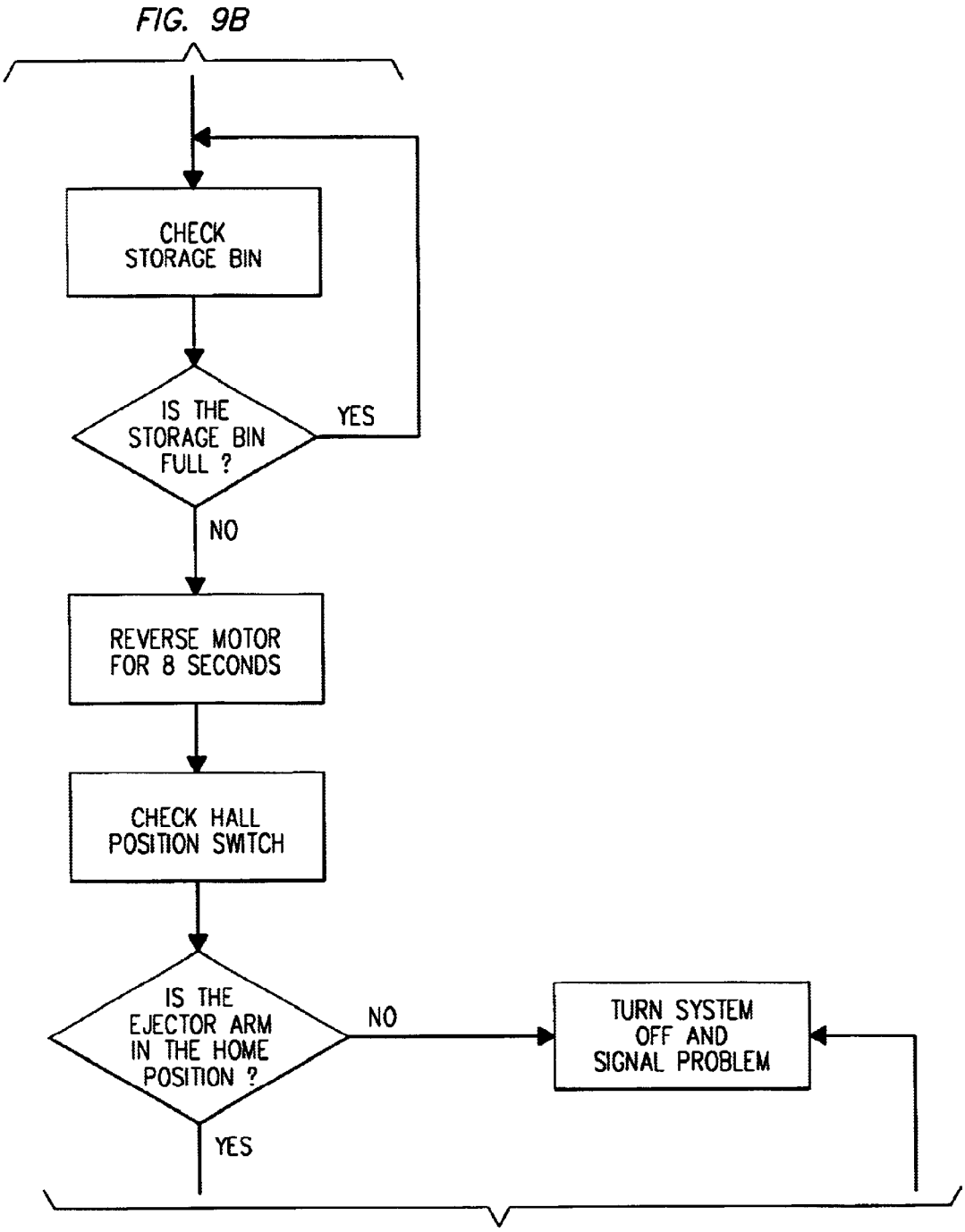
Figures 9C, 9D:
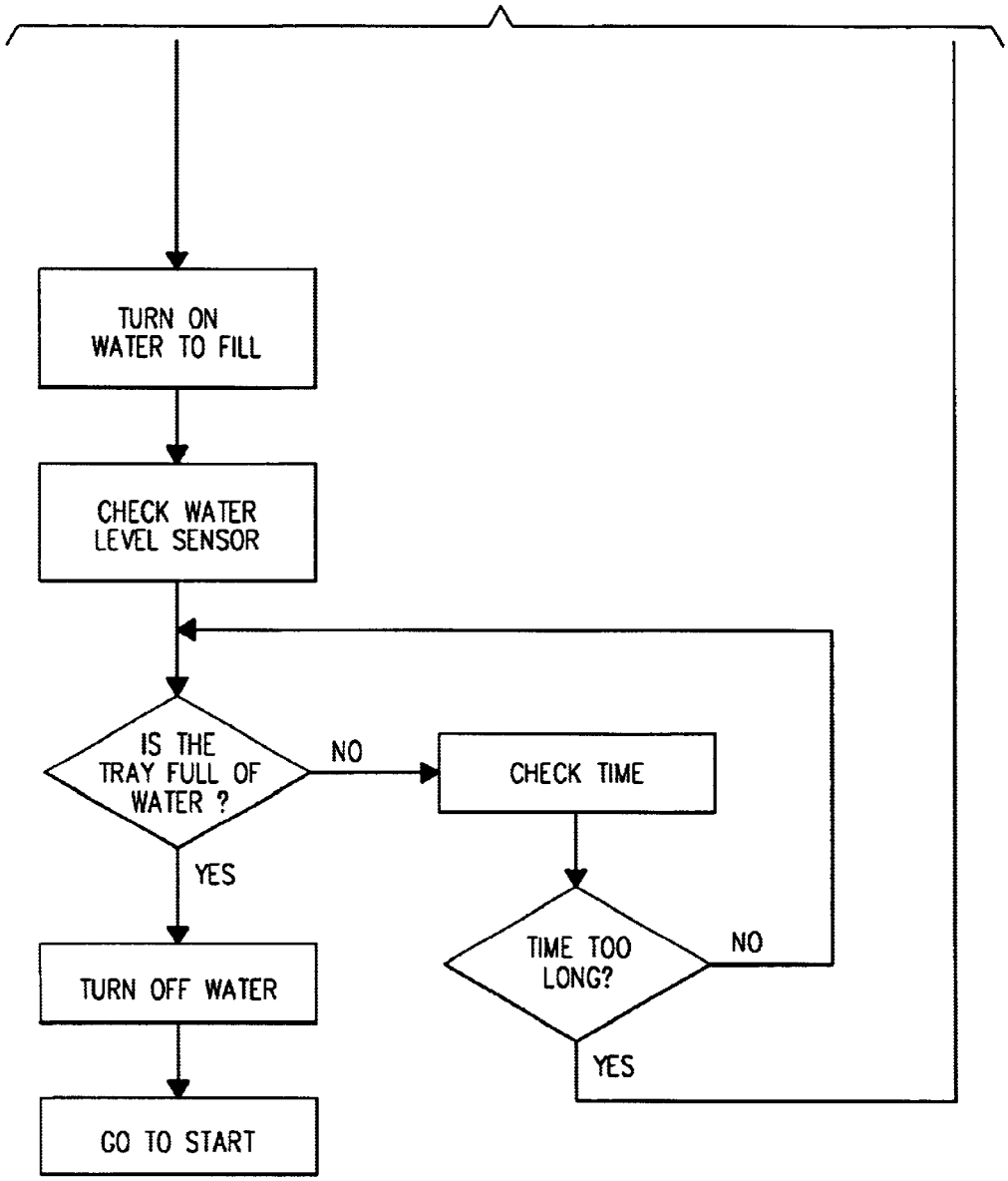

More specifically, as shown in the electrical schematic, designated as FIG. 8 of the drawings, the ice maker 10 comprises the grounded combination heat sink support bracket 40 attaching to the wall of the freezer compartment, further attaching to and supporting a reversible low voltage electric motor 42 having a motor shaft 44, a power supply transformer 21, a large capacitor 22, a fast acting fuse 23, the programmable microcontroller 20, the metal ice tray 50 having the plurality of cylindrical cups 54, each having cylindrical sides 56 and a bottom 58, the metal ice tray 50 attaching to the support bracket 40 by a support rod 60, the support rod 60 exposed through the bottom 58 of each of the cylindrical cups 54 with an ejection arm 62 attached to the support rod 60 in the bottom 58 of each cylindrical cups 54, the ejection arms 62 causing ice cubes formed in the cylindrical cups 54 to be ejected when the support rod 60 is rotated, a plurality of electric heater resistors 64 attached to an underside 52 of the metal ice tray 50, at least one electronic water level indicator 70 and at least one water temperature indicator 74 in at least one of the cylindrical cups 54, a motor arm 80 attaching to the motor shaft 44, an ejector arm 82 attached to the support rod 60, at least one spring 84 attaching the motor arm 80 to the ejector arm 82, an arm catch 86, an upright bin level bail 90, a bin level motor 92 with a bin level adjustment means 94, an ice cube bin 100, a bin level hall switch 24, a rotation hall switch 26 and a position hall switch 28 to monitor the position and rotation of the metal ice tray 50 during the operation of the ice maker 10, a voltage regulator 27, an oscillator 28, at least two optoisolators 29, at least two triac switches 30, a plurality of resistors R1–R15, a plurality of capacitors C1–C5, a plurality of transistors Q1–Q4, an LED 34, a diode D1, a reset switch 36, and the PC board 15 upon which the multiplicity 14 of electronic components are affixed, pursuant to FIGS. 6 and 7 of the drawings.

The program by which the microcontroller 20 controls the ice maker 10 is shown in the logic flow chart indicated in FIGS. 9*a*–9*d* of the drawings. As indicated in this flow chart, the ice maker 10 includes several opportunities for the ice maker 10 to check a status of the operating system and shut down the system when a problem is sensed or a desired feedback is not obtained. The reset switch 36 must be reset and the problem alleviated before reactivation of the system is allowed.

Due to the microcontroller 20 being the central control mechanism, as again indicated in the flow chart in FIGS. 9*a*–9*d*, system shutdown occurs when one of several event occurs. First, if the ejection arm 62 fails to return to a home position, sensed by the rotation hall switch 25 and the position hall switch 26, due to the failure of the metal ice tray 50 to return to a level position, failure of the ejection arm 62 to return to the its position in the bottom 58 of the cylindrical cups 54, or the support rod 60 does not turn, the system deactivates and a problem is signaled by the illumination of the LED 34. If the electric heater resistors 64 take too long to heat the ice tray 50, the system deactivates and the LED 34 is illuminated. If the electronic water level indicator 70 takes too long to indicate that the cylindrical cups 54 are full of water, the system deactivates and the LED 34 is again illuminated.

The basic operation of the ice maker 10 commences by first installing the ice maker to the wall in the freezer compartment of the refrigerator and attaching the water supply and electrical supply to the ice maker. The ice maker 10 is positioned with the cylindrical cups 54 in an upright position to receive water. Water fills the cylindrical cups 54 until the water level indicator 70 senses a filled level, most preferably by an electrical bridge between two stainless steel plates 72, with the electrical bridge completed by the water between the two stainless steel plates 72.

The water flow is ceased and the ice is formed, until such time as the water temperature indicator 74, most preferably a 10K @25 degree centigrade NTC Thermistor sensor 76, is activated, signaling the microcontroller 20 to commence a cycle to empty the ice from the ice tray 50. The electronic heater resistors 64 are activated, attached to the underside 52 of the ice tray 50. The reversible low voltage electric motor 42 begins to turn the motor shaft 44 connected to the support rod 60, commencing a tilting of the metal ice tray 50 and the ejection arms 62, separating the metal ice tray 50 from contact with the support bracket 40, until a programmed point is reached, preferably thirty degrees from horizontal, at which time an ice tray catch 59 on the support bracket 40 stops the ice tray 50 rotation. At the same time the motor arm 80 and the ejector arm 82 begin to move with the spring 84 attached between the motor arm 80 and the ejector arm 82 tightening to a point where the motor arm 80 pulls the ejector arm 82, and the electric motor 42 further rotates the motor arm 80 another ten degrees, at which time the electric motor 42 deactivates. The electronic heater resistors 64 continue to heat until the ice cubes are released from the cylindrical cups 54, wherein the spring pressure causes the ejection arms 62 to lift the ice cubes from the bottom 58 of the cylindrical cups 54. The movement of the ejection arms 62 is approximately an eighth of an inch from the bottom 58 of the cylindrical cups 54, the ejection arm 82 arrested by the arm catch 86 which movement signals the microcontroller 20 to deactivate the electric heater resistors 64. The electric motor 42 rotates the motor arm 80 another short period releasing the arm catch 86, rapidly releasing the ejection arms 62 propelling the ice cubes from the cylindrical cups 54 into the ice cube bin 100.

The bin level bail 90 is then lowered to a set level determined by the bin level adjustment means 94, into the ice cube bin 100. If the ice cube bin 100 is full, the microcontroller 20 turns off the electrical motor 42. No ice is produced until some ice is removed from the ice cube bin 100. If the ice cube bin 100 is not full, the microcontroller 20 reverses the electrical motor 40 raising the bin level bail 90 by activating the bin level motor 92 and returning the ice tray 50 to its horizontal position. The ice tray 50 is thus positioned against the support bracket 40 dissipating the heat of the ice tray 50 during contact, promoting a quicker cooling of the ice tray 50 and expediting the formation of ice in the ice tray 50. The microcontroller 20 signals the water supply to provide water to the cylindrical cups 54 in the ice tray 50, and the cycle continues unless a problem in the system is detected, at which time the microcontroller 20 deactivates the ice maker 10 and illuminates the LED 34 until the detected problem is remedied and the reset switch 36 is activated, allowing the ice maker 10 to resume operation.

The means 12 of ejecting the ice cubes from the metal ice tray 50 is disclosed in a best mode above by the interaction of the support rod 60, the ejection arms 62 in the bottom 58 of the cylindrical cups 54, the motor arm 80 and ejector arm 82, and the spring 84. The means 16 of sensing the level of ice in the ice cube bin 100 is performed by the bin level bail 90, the bin level sensor 92, the bin level hall switch 24 and the bin level adjustment means 94. The means 13 of heating the metal ice tray 50 is accomplished by the electric heater resistors 64 attached to the underside 52 of the metal ice tray 50, and the means 18 of monitoring the ice maker is performed by the interaction of the microprocessor 20 and the multiplicity 14 of electrical components.

Figure 2:
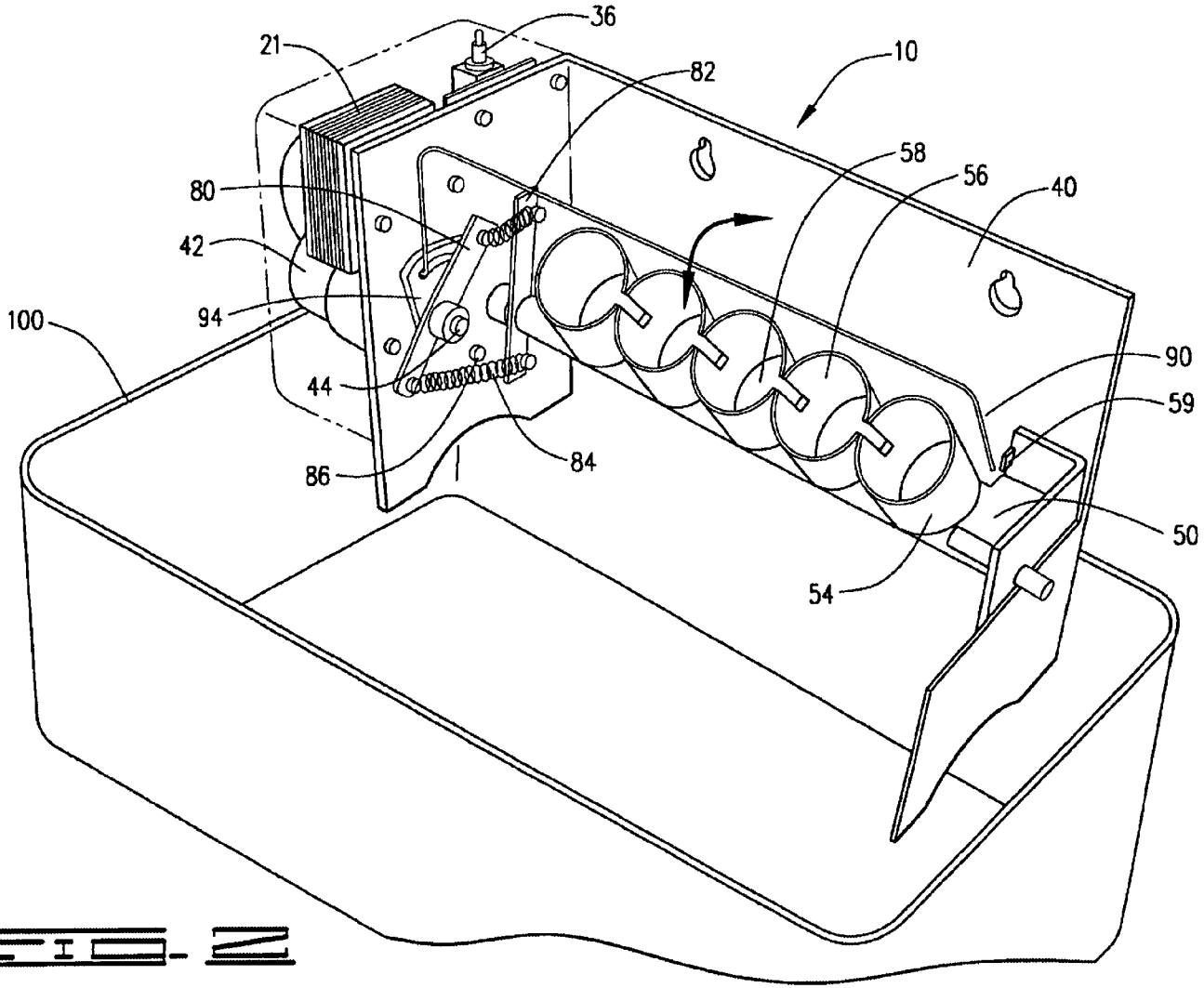
FIG. 2 is a reverse perspective view of the invention.
Figure 3:
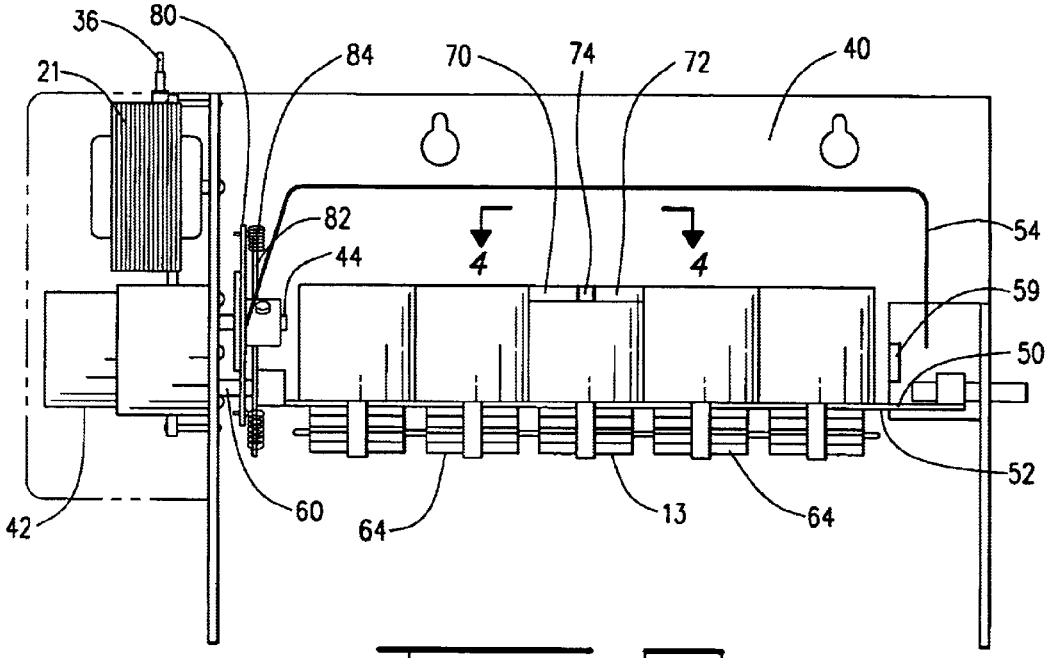
FIG. 3 is a front view of the invention.
Figure 5:
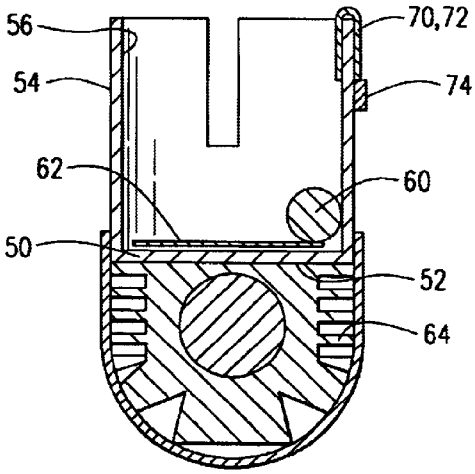
FIG. 5 is a cross section of a cylindrical cup with a cross section of an electric heater resistor.
Figure 5:
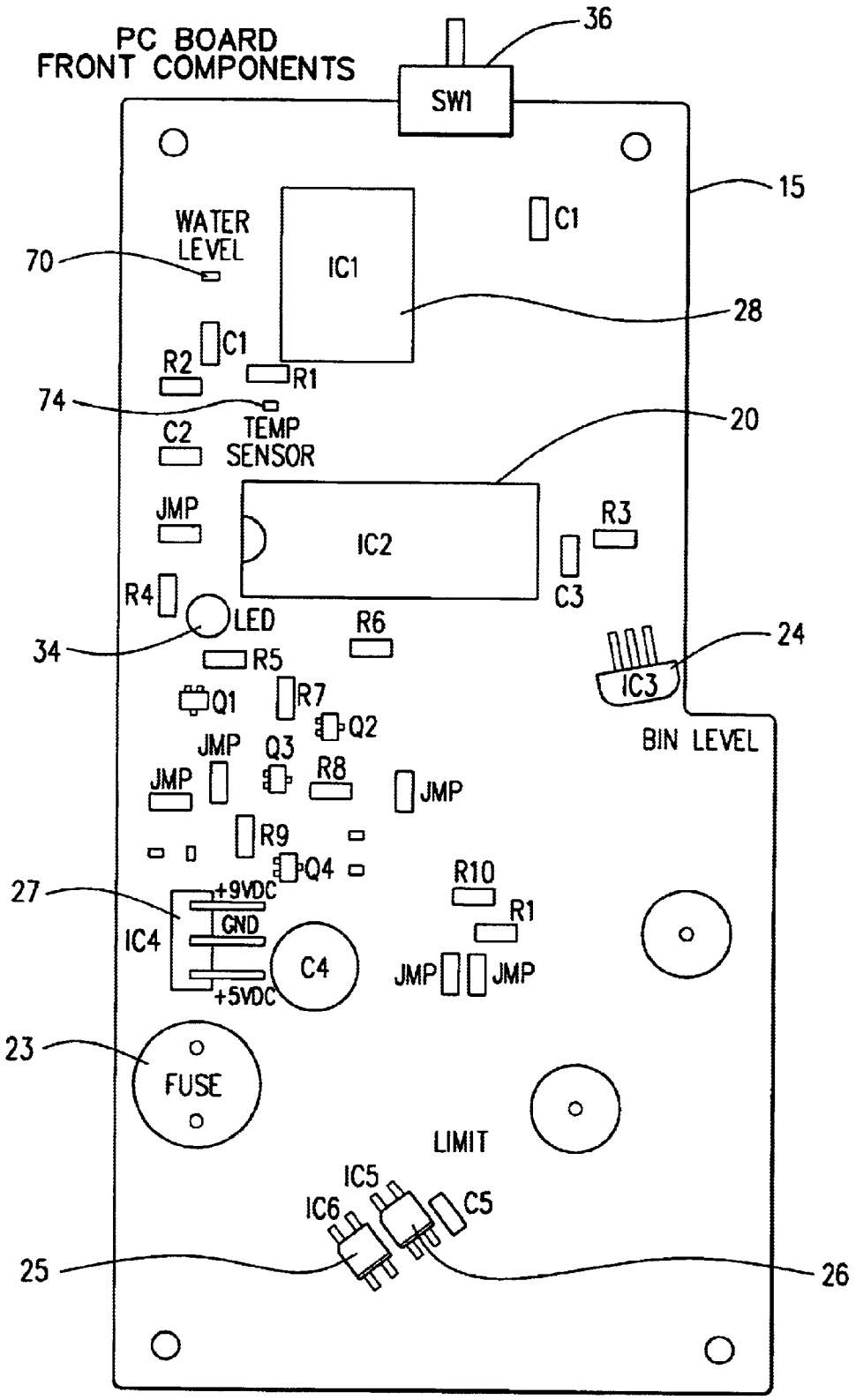

Most preferably, the plurality of cylindrical cups 54 are constructed on a common base creating the metal ice tray 50 to form multiple ice cubes. The support rod 60, approximately 0.25 inches in diameter, passes through one end of the base of the metal ice tray 50. along the bottom 58 of each of the cylindrical cups 54, out the other end of the metal ice tray 50, as indicated in FIGS. 2, 3 and 5 of the drawings. The support rod 60 is exposed in the bottom of each of the cylindrical cups 54 as it passes through the base of the metal tray. Attached to the support rod 60 at a ninety degree angel, resting on the bottom 58 and coinciding with the center of each cylindrical cup 54 are one of each of the ejection arms 62 that lift the ice cubes from each cylindrical cup 54 when the support rod 60 is rotated relative to the metal ice tray 50.

The ejector arm 82 is securely fastened on the support rod 60 where it extends from the metal ice tray as shown in FIG. 2 of the drawings. The support rod 60 extends through the support bracket 40. providing pivotal support for one end of the metal ice tray 50, while the opposing end of the metal ice tray 50 is directly pivotally attached to the support bracket 40.

The motor 42 is drivingly coupled through the motor arm 80, springs 84, and ejector arm 82 to the support rod 60. The support rod 60 and the metal ice tray 50 rotate in unison until the ice tray catch 59, formed as part of the support bracket 40, engages the base of the metal ice tray 50 stopping its rotation thirty degrees from vertical. The support rod 60 rotates another sixty degrees, raising the ejection arms 62 pushing the ice cubes from the cylindrical cups 54.

Figure 4:
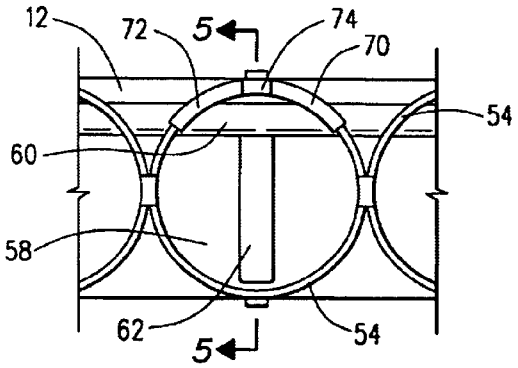
FIG. 4 is a top view of a cylindrical cup on the ice tray.

Most preferably, two stainless steel plates 70, 72 are fastened to the cylindrical cups 54 as indicated in FIGS. 3–5 of the drawings, extending downward approximately 0.375 inches into the cylindrical cups 54, spaced apart approximately 0.0625 inches, electrically insulated from the metal ice tray 50. A very small amount of voltage is applied to one of the plates 70 and when enough water has bridged the space between the plates 70, 72, the electric current through the water creates approximately 2.5 volts at the second plate 72. This voltage is programmed as the full point in the microcontroller IC2 program. To prevent flooding from a malfunction, the program also includes a maximum fill time within the program.

The water temperature sensor 74, is specifically identified as the 10 k @25degrees centigrade NTC Thermister 76. To keep the Thermister 76 temperature equal to the cylindrical cups 54 temperature, the Thermister 76 is fastened in close physical contact with the outside of one of the cylindrical cups 54. The 20 k resistor R1 is connected between the 5 VDC power source off the voltage regulator 27 an one of the leads of the Thermister 76. while another lead of the Thermister 76 is connected to a system ground. The voltage present at the connection of the Thermister 76 and resistor R1 is approximately 2.88 volts when the metal ice tray 50 is filled with water. The voltage increases to 3.8 volts when the ice cubes become frozen.

When the electrical heater resistor 64 energizes, warming the metal ice tray 50, the voltage decreases to 3.2 volts and the ice cubes are released and ejected from the cylindrical cups 54 by the previously described ejection method. The voltage present at the Thermister 76 and resistor R1 junction is connected to pin 17 of the microcontroller IC2, and the microcontroller is programmed to generate controls based upon the voltage detected on pin 17.

In a preferred embodiment, as shown in FIGS. 6–8 of the drawings, the multiplicity 14 of electrical components attaching to the PC board 15 which the ice maker 10 utilizes includes a PIC16C71 microcontroller 20, which has been found to produce the operational programmed result. The two triac switches 30, used to switch AC power with in the system, are preferably T410-600 B snubberless triac switch. The reset switch 36 is preferably an SPST switch, and the fuse 23 is preferably a TR-5 fast acting 1 amp fuse. The optoisolators 29 are most preferably MOC3042 semiconductors and the electrical heater resistors 64 are best embodied as at least five 25 watt 25 ohm power resistors in series. Additionally, in the preferred embodiment, there area total of 15 resistors R1–R15, ranging from 330 ohms to 40 K ohms, four capacitors C1–C4, ranging from 0.1 $\mu$F to 1.0 $\mu$F, ten semiconductors, including the microcontroller 20, the two snubberless triac switches 30, the bin level hall switch 24, the rotation hall switch 25 and the position hall switch 26, the voltage regulator 27, the oscillator 28 and the two optoisolators 29 listed above, four transistors Q1–Q4, one diode D1, and one LED 34.

While the invention has been particularly shown and described with reference to a preferred embodiment thereof, it will be understood by those skilled in the art that changes in form and detail may be made therein without departing from the spirit and scope of the invention.

What is claimed is:

1. A microcontroller controlled ice maker attaching to a wall of a freezer compartment of a refrigerator, utilizing an existing water line and an electrical supply within the freezer compartment, the ice maker essentially comprising:

a grounded combination heat sink support bracket;

a low voltage electrical motor;

a metal ice tray having a plurality of cylindrical cups;

a water level indicator;

a water temperature indicator;

a means of ejecting ice cubes from the metal ice tray during rotation of the metal ice tray;

a means of heating the metal ice tray to aid in the removal of the ice cubes from the ice tray;

a multiplicity of electrical components, including a microcontroller, attaching to a PC board to compel the operation of the ice maker;

a means of sensing the level of ice in an ice cube bin to determine whether to continue the production of ice cubes by the ice maker; and a means of monitoring the ice maker to deactivate the ice maker in the event of a failure within the ice maker.

2. A microcontroller controlled ice maker attaching to a wall of a freezer compartment of a refrigerator, utilizing an existing water line and an electrical supply within the freezer compartment, the ice maker, essentially comprising:

a grounded cominbination heat sink support bracket attaching to the wall of the freezer compartment, further attaching to and supporting;

a reversible low voltage electric motor having a motor shaft;

a power supply transformer;

a large capacitor;

a fast acting fuse;

a programmable microcontroller;

a metal ice tray having a plurality of cylindrical cups having cylindrical sides and a bottom, the metal ice tray attaching to the support bracket by a support rod, the support rod exposed through the bottom of each of the cylindrical cups with an ejection arm attached to the support rod in the bottom of each cylindrical cups, the ejection arms causing ice cubes formed in the cylindrical cups to be ejected when the support rod is rotated;

a plurality of electric heater resistors attached to an underside of the metal ice tray;

at least one electronic water level indicator and at least one water temperature indicator in at least one of plurality of cylindrical cups;

a motor arm attaching to the motor shaft;

an ejector arm attached to the support rod;

a spring attaching the motor arm to the ejector arm;

an arm catch;

an upright bin level bail;

a bin level motor with a bin level adjustment means;

an ice cube bin;

a bin level hall switch;

a rotation hall switch and a position hall switch to monitor the position and rotation of the metal ice tray during the operation of the ice maker;

a voltage regulator;

an oscillator;

at least two optoisolators;

at least two triac switches;

a plurality of resistors;

a plurality of capacitors;

a plurality of transistors;

an LED;

a diode;

a reset switch; and a PC board.

3. The invention, as disclosed in claim 2, further comprising:

the microcontroller is a PIC16C71 microcontroller;

the two triac switches, used to switch AC power within the system, are preferably T410-600 B snubberless triac switches;

the reset switch is preferably an SPST switch;

the fuse is preferably a TR-5 fast acting 1 amp fuse;

the optoisolators are most preferably MOC3042 semiconductors;

the electrical heater resistors are at least five 25 watt 25 ohm power resistors in series;

the plurality of resistors number fifteen, ranging from 330 ohms to 40 K ohms, the plurality of capacitors number four, ranging from 0.1 $\mu$F to 1.0 $\mu$F, the total number of semiconductors number ten, including the microcontroller, the snubberless triac switches, the bin level hall switch, the rotation hall switch and the position hall switch, the voltage regulator, the oscillator and the optoisolators;

the water temperature indicator is a 10 K @ 25 degree centigrade NTC Thermistor sensor; and the water level indicator is provided as an electrical bridge between two stainless steel plates, with the electrical bridge completed by the presence of water between the two stainless steel plates.

* * * * *